United States Patent [19]

Kiyokane

[11] Patent Number: 4,804,133

[45] Date of Patent: Feb. 14, 1989

[54] ADVERTISING DEVICE

[75] Inventor: Jerrilyn C. Kiyokane, Long Beach, Calif.

[73] Assignee: Namkung Promotions, Inc., Costa Mesa, Calif.

[21] Appl. No.: 85,703

[22] Filed: Aug. 17, 1987

[51] Int. Cl.[4] ..... B65D 5/42

[52] U.S. Cl. ..... 229/8; 206/457; 229/904; 446/76; 446/80

[58] Field of Search ..... 229/8, 904; 206/457; 446/73, 75–78, 80, 93, 95; D9/308

[56] References Cited

U.S. PATENT DOCUMENTS

| | | | |
|---|---|---|---|
| 654,219 | 7/1900 | Bender, Jr. | 446/76 |
| 1,547,176 | 7/1925 | Lazaron | 446/77 |
| 2,665,522 | 1/1954 | Junod | 446/75 |
| 2,875,940 | 3/1959 | Dunn | 229/904 |
| 3,224,660 | 12/1965 | Willis et al. | 229/8 |
| 4,055,250 | 10/1977 | Mayhew | 229/8 |
| 4,643,697 | 2/1987 | Sheffer | 446/80 |
| 4,657,520 | 4/1987 | Sheffer | 446/80 |

FOREIGN PATENT DOCUMENTS

| | | | |
|---|---|---|---|
| 613250 | 1/1961 | Canada | 229/8 |

*Primary Examiner*—Jimmy G. Foster
*Assistant Examiner*—Gary E. Elkins
*Attorney, Agent, or Firm*—James E. Brunton

[57] ABSTRACT

An advertising device comprising a single planar sheet of cardboard or like material which is printed on one side, die cut, glued and provided with fold or score lines and locking means which enable the sheet of material to be readily folded and then locked into a three-dimensional configuration having the appearance of a toy truck or automobile. In the three-dimensional configuration, compartments are defined for receipt of food items such as hamburgers, French fries and the like.

5 Claims, 4 Drawing Sheets

ADVERTISING DEVICE

BACKGROUND OF THE INVENTION

1. Field of the Invention

The present invention relates generally to an advertising and promotional item. More particularly, the invention concerns a foldable food tray in the configuration of a toy car, truck, or the like for use in fast food establishments as a takeout container for food items.

2. Discussion of the Prior Art

Fast food takeout restaurants have become very popular in recent years. Many such restaurants cater to people with small children and frequently provide toys and other entertainment items along with food served to a child to promote the restaurant and entertain the child. To be commercially successful, such promotional items must be clever, attractive and inexpensive to produce.

The novelty item of the present invention satisfies the aforementioned requirements, being both appealing to children and inexpensive to manufacture. The item is constructed from a single planar sheet of cardboard, or like material, which is printed on one side and then die cut and folded along prescribed fold lines to form a food tray having the appearance of a toy vehicle. In one form of the invention, the item simulates the appearance of a convertible automobile with the passenger compartment providing the receptacle for the food items. In another embodiment of the invention, which simulates the appearance of a truck, the truck bed functions as the receptacle for the food items.

SUMMARY OF THE INVENTION

It is an object of the present invention to provide a novelty item in the form of a foldable food tray having the appearance of a toy vehicle which can be used in fast food take-out establishments to promote their products.

Another object of the invention is to provide an item of the aforementioned character which can be inexpensively produced, stored, and delivered to the user in planar form, and then quickly and easily assembled into a three-dimensional food tray.

A further object of the invention is to provide a food tray of the class described which is attractive to children and usable as a toy after the food items contained therein have been consumed.

Still another object of the invention is to provide a novelty item for use by fast food establishments and the like which can serve as a vehicle for distributing coupons for free or discounted children's meals, thereby encouraging customers to return to the food establishment.

In summary, the foregoing objects are realized by an advertising device comprising a single planar sheet of cardboard or like material which is printed on one side, die cut, glued and provided with score lines and locking means which enable the sheet of material to be readily folded and then locked into a three-dimensional configuration having the appearance of a toy truck or automobile.

DESCRIPTION OF THE INVENTION

Figure 1:
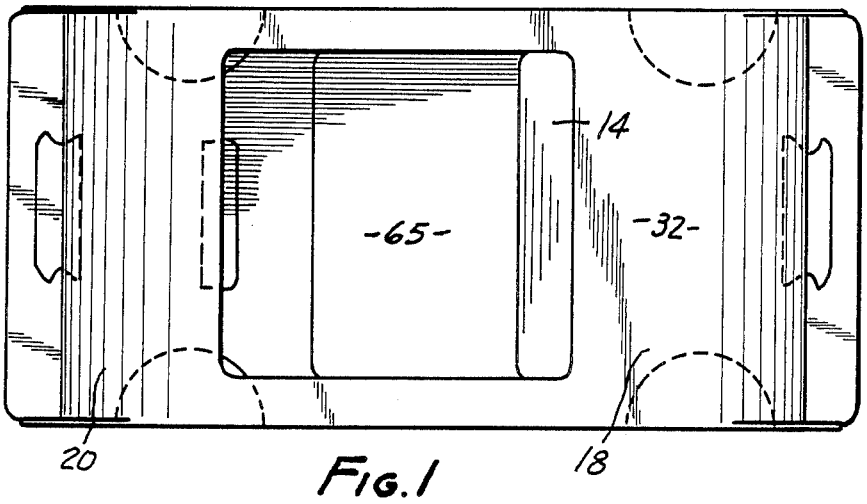
FIG. 1 is a plan view of one form of the advertising device of the present invention.

Referring to the drawings and particularly to FIGS. 1 through 4, one form of advertising device of the present invention is there illustrated. The advertising device is particularly adapted for use by fast food takeout restaurants and the like as a foldable children's food tray, having, for example, the configuration shown in FIGS. 1, 2, and 3. The device is folded from a single, generally planar sheet of relatively stiff foldable material such as cardboard or the like of the character shown in FIG. 4. The planar sheet 12 is first printed with suitable indicia on one side and then die cut into a configuration such as that shown in FIG. 4.

Figure 4:
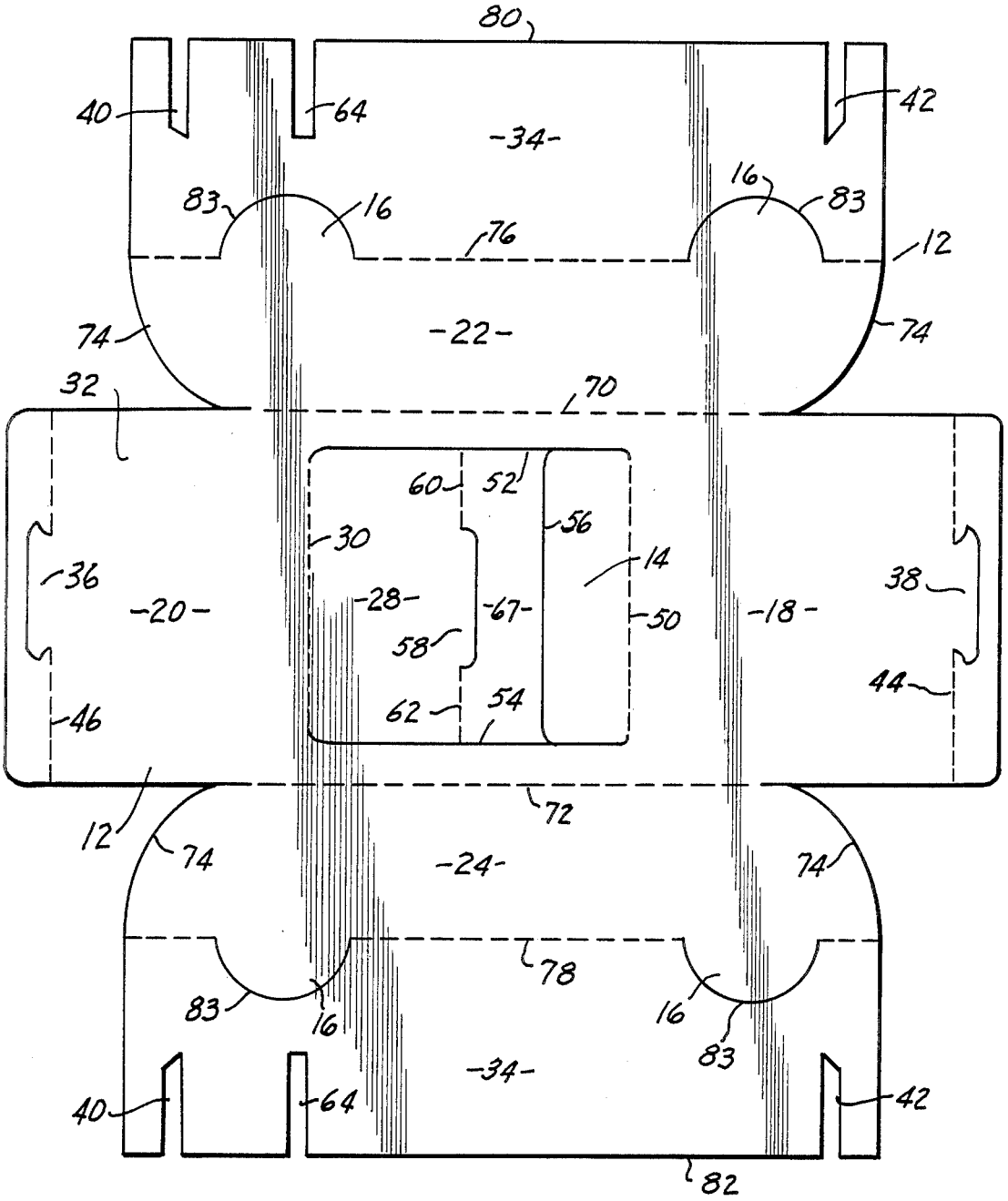
FIG. 4 is a plan view of the pre-cut planar material which is folded and appropriately interlocked to form the usable configuration of the device.

By way of example, the planar sheet of material 12, as shown in FIG. 4, may have indicia printed on the upper surface thereof simulating a windshield 14, wheels 16, a hood and a grill 18, a rear deck 20, and sides 22 and 24, respectively. Additionally, in one form of the invention, a portion of the planar sheet, designated by the numeral 28, comprises a pre-printed coupon which may be removed from the device along perforated score-lines 30 and redeemed at the fast food outlet for free, or discounted meals for children.

Figure 2:
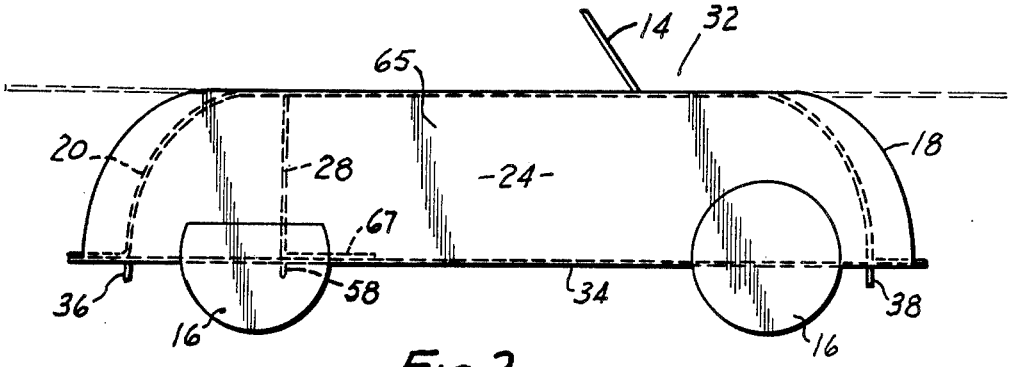
FIG. 2 is a side view of the device.

Turning particularly to FIGS. 1 and 4, the embodiment of the invention there shown includes a first portion generally designated by the numeral 3 which simulates the vehicle top. Referring also to FIGS. 2 and 4, it can be seen that the device includes a second portion generally designated by the numeral 34 which simulates the vehicle bottom. A third portion, previously identified by the numeral 22, simulates one side of the vehicle and a fourth portion, previously identified by the numeral 24, simulates the other side of the vehicle.

As best seen by referring to FIG. 4, the first, second, third, and fourth portions of the device are divided by a plurality of longitudinally extending fold or score lines. By folding the sheet along these fold or score lines, the planar sheet can be folded into a vehicle-simulating configuration of the character shown in FIGS. 1 through 3, wherein at least parts of said first and second portions 32 and 34 are disposed in spaced apart, generally horizontal planes, and in which said third and fourth portions 22 and 24 are disposed in transversely spaced apart, generally vertically extending planes. In order to lock the first, second, third, and fourth portions of the device in the vehicle-simulating configuration illustrated in FIGS. 1 through 3, locking means are provided. In the embodiment of the invention shown in FIGS. 1 through 4, these locking means comprise first and second downwardly extending tabs 36 and 38, respectively, which are die cut into planar sheet 12 and then lockably inserted into transversely extending slots 40 and 42, respectively, which are die cut into planar sheet 12 at strategic locations.

Turning to FIG. 4, the first, or top-simulating, portion 32 of the device, comprises an elongated central portion of the planar sheet 12. This central, or first, portion 32 has a first transversely extending fold or score line 44 disposed proximate one end thereof, and a second transverse fold line 46 disposed proximate the opposite end thereof. The previously identified die cut locking tab 36 is disposed proximate fold line 46, while the die cut locking tab 38 is disposed proximate fold or score line 44.

Located intermediate fold lines 44 and 46 is the previously identified perforated score line 30, which comprises a third score line, and a fourth fold or score line 50 which is spaced apart a pre-determined distance from fold or score line 30. Extending between fold lines 30 and 50 are transversely spaced, longitudinally extending cuts 52 and 54. Disposed intermediate third and fourth transverse fold or score lines 30 and 50 is a transversely extending cut 56 which extends between cuts 52 and 54. As best seen in FIG. 4, the portion of planar material disposed between transverse cut 56 and fold line 50 corresponds with the indicia simulating the automobile windshield 14.

Figure 3:
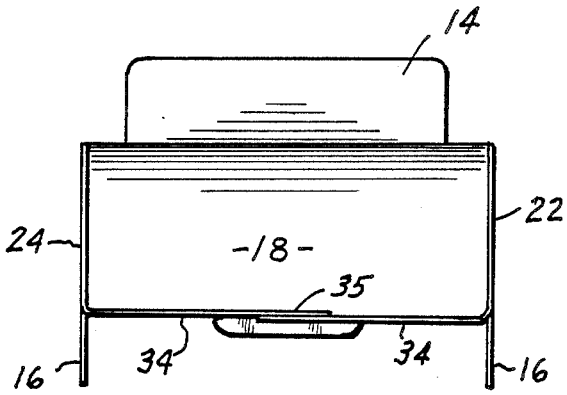
FIG. 3 is a rear view of the device.

In the embodiment of the invention shown in FIGS. 1 through 3, the portion 28, which can comprise a refundable coupon, is foldable downwardly toward the automobile floor 34 and is locked in place by means of a second locking means, namely a tab portion 58, which is die cut into the planar sheet 12. On either side of tab 58 are perforated score or fold lines 60 and 62, respectively. These score lines permit the tab to extend downwardly and be lockably received in slots 64 provided in portions 34 of the planar sheet. As best seen in FIG. 2, when portion 28 is folded downwardly in the manner there shown with tab 58 extending through the slots 64, the portion located between the windshield 14, fold or score line 30, and transverse cuts 52 and 54, comprises a compartment generally designated in FIG. 2 by the numeral 65. This compartment is preferably of a size to receive a small hamburger, French fries, or like fast food take-out items. When portion 28 is folded downwardly so that tab 58 extends into slots 64, a portion 67 (FIG. 2) is disposed in engagement with the inner surface of the automobile bottom-defining panel 34, thereby further stabilizing the vehicle and the food-receiving compartment 65.

In this first embodiment of the invention, first and second side portions 22 and 24 are disposed adjacent the central portion 32, and are divided therefrom by first and second longitudinally extending fold or score lines 70 and 72. As best seen in FIG. 4, each side portion 22 and 24 has curved edge portions 74 which tangentially join fold lines 70 and 72. Bottom edge-defining fold or score lines 76 and 78 are disposed intermediate fold or score lines 70 and 72 and the longitudinally extending edge portions 80 and 82 of the planar sheet as viewed in FIG. 4.

To simulate the wheels of the automobile, a pair of longitudinally spaced arcuate cuts are provided in each bottom-defining portion 34 of the device proximate score lines 76 and 78. These arcuate cuts 83 correspond with the indicia printed on the planar material which simulates the lower half of the toy automobile wheels 16.

In manufacturing the food tray item illustrated in FIGS. 1 through 4, large sheets of planar material such as paperboard are pre-printed to simulate the various component parts of the automobile. The large sheets are then die cut and scored along the die cut and score lines previously identified. Next, the sheet is folded and glued to expedite assembly of the food tray at the fast food establishment. In constructing the tray illustrated in FIGS. 1 through 4, the side portions are folded relative to the central portion 36 along fold lines 70 and 72. Next, the bottom portions 34 are folded inwardly along fold lines 76 and 78 so that the device takes on the configuration shown in FIG. 3. The bottom-defining panels 34 are then joined together by an adhesive provided on the central overlapping portions 34, which central portion is identified in FIG. 3 by the numeral 35. With the bottom panels 34 adhered together in the manner shown in FIG. 3, side panels 22 and 24 assume a generally vertical orientation. As the bottom panels 34 are folded inwardly, the portions 16, which simulate the lower half of the vehicle wheels, will remain in a co-planar configuration with side panels 22 and 24, and will extend downwardly from bottom panels 34 in the manner illustrated in FIG. 3.

Once the bottom panels have been joined by adhesive or other suitable joining material at the area 35, the windshield portion 14 is bent upwardly along score line 50. Next, the front portion 18 of the central panel is bent downwardly in the manner shown in FIG. 2 so that the tab portion 38 extends through slots 42 formed in the bottom panels. This done, the rear deck portion 20 of the central panel is folded downwardly in the manner shown in FIG. 2 and tab 36 is inserted into slots 40 formed in the bottom panels 34. Finally, portion 28 of the central panel is bent downwardly in the manner previously described, and locking tab 58 is inserted through slot 64.

With the planar sheet of FIG. 4 folded and interlocked in the manner described in the preceding paragraphs, the food tray takes on a highly stable configuration so that food articles can be inserted into the compartment 65 and delivered to the customer. After the food has been consumed, the promotional device of the invention can be taken home by the child and will function as a plaything for the child, and an advertising reminder of the fast food takeout establishment to the parent.

Figure 6:
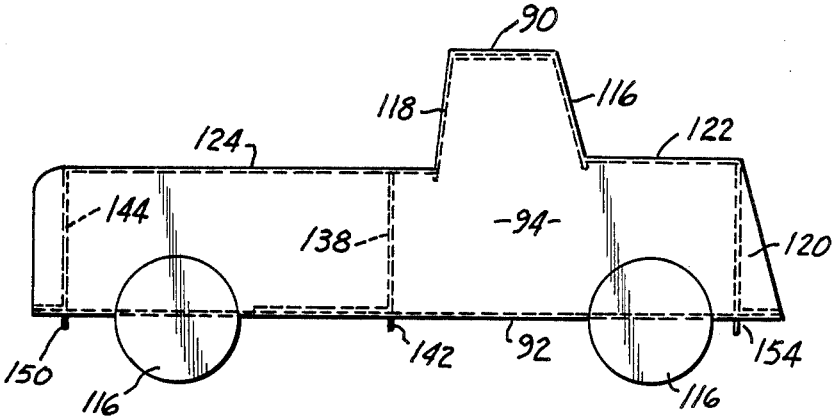
FIG. 6 is a side view of the alternate form of the invention.
Figure 7:
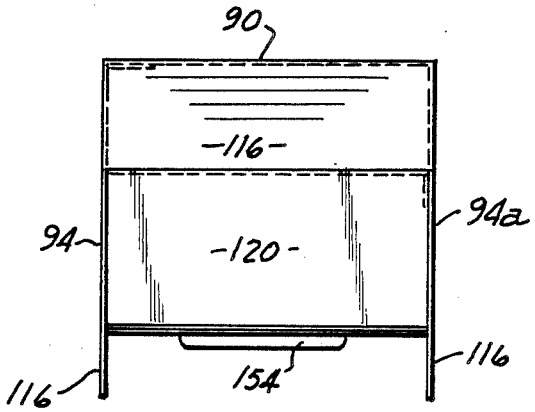
FIG. 7 is a rear view of the device.
Figure 8:
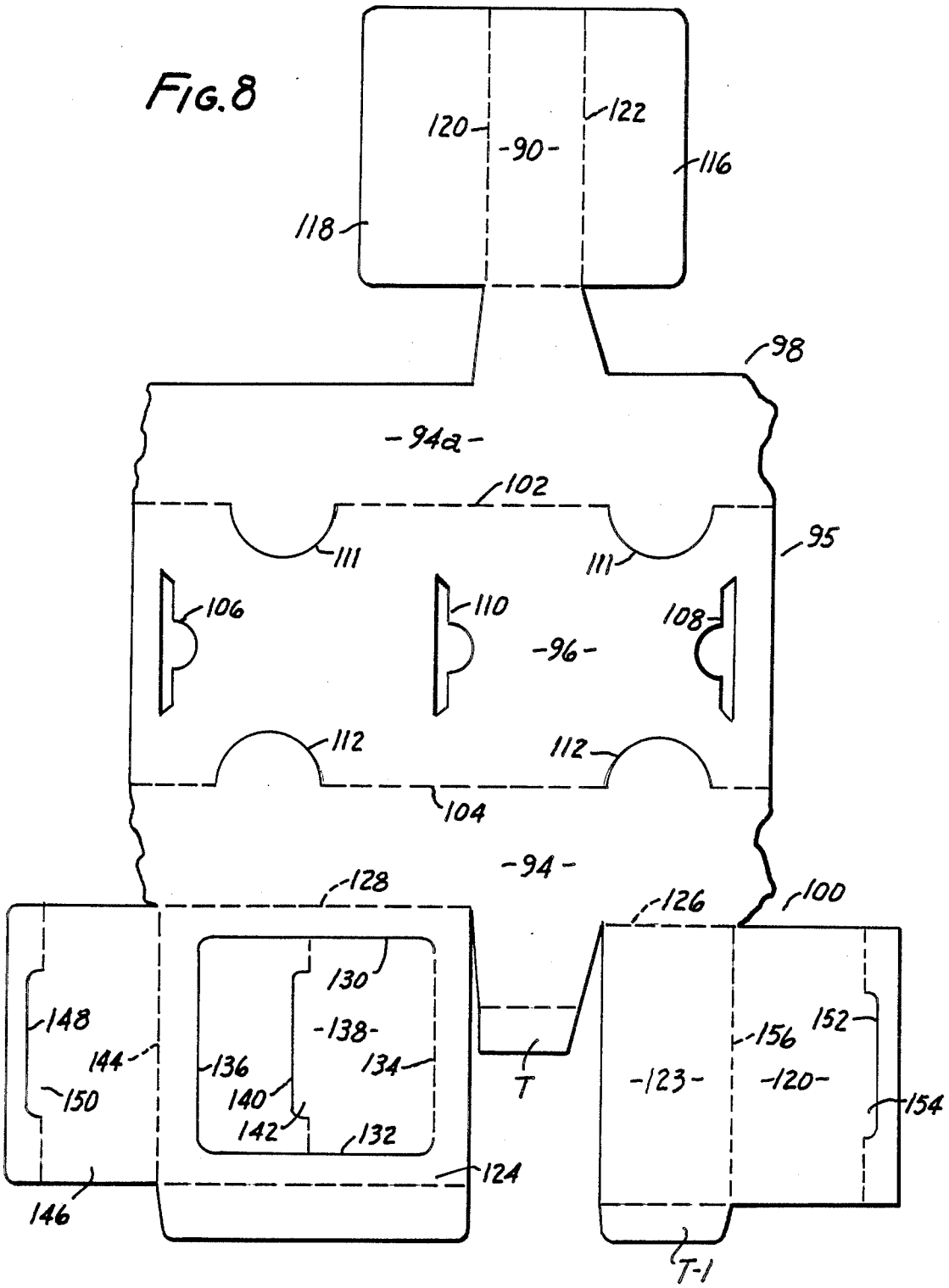
FIG. 8 is a plan view of the pre-cut planar material which is folded and appropriately interlocked to form the configuration of the alternate embodiment of the device illustrated in FIGS. 5 through 7.

Turning now to FIGS. 5, 6, 7, and 8, another embodiment of the advertising device of the present invention is there illustrated. In this form of the invention the advertising device takes on the appearance of a toy truck having a top, a bottom, and spaced apart sides defined respectively by the numerals 92, 94, and 94A. Referring particularly to FIG. 8, the device of this form of the invention comprises a single, generally planar sheet of relatively stiff, foldable material generally designated by the numeral 95. Material 95 has first and second sides with the first side having indicia printed thereon simulating a windshield, a hood, grill, a rear window, a bed, and wheels of the truck.

Sheet 95 includes an elongated central portion 96 simulating the bottom of the truck, and first and second side portions generally designated by the numerals 98 and 100 disposed adjacent central portion 96. First and second side portions 98 and 100 are divided respectively from central portion 96 by first and second longitudinally extending fold lines 102 and 104.

As best seen in FIG. 8, central portion 96 includes a first perforation or die cut slot 106 provided proximate one end of the central portion, and a second perforation or die cut slot 108 provided proximate the other end thereof. A third perforation or die cut slot 110 is provided intermediate first and second perforation 106 and 108. The purposes of perforations 106, 108, and 110, which comprise the locking means of this form of the invention, will presently be discussed. Also formed in central portion 96 are first and second pairs of longitudinally spaced arcuate cuts 111 and 112. Cuts 111 are disposed proximate score line 102, while cuts 112 are disposed proximate score line 104. Each of the cuts 111 and 112 corresponds with the indicia printed on the sheet simulating the lower half of the truck wheels 114 (FIGS. 6 and 7).

First side 98 of planar sheet 95 includes a section corresponding with truck side **94*a* and a section corresponding with the indicia imprinted on one side of the sheet 94 simulating the truck windshield 116 and the truck rear window 118 of the previously identified top 90. Fold or score lines 120 and 122 are provided along the margins of top section 90**.

The second side 100 includes a section corresponding with the previously identified truck side 94; a section corresponding with the indicia imprinted on the sheet simulating the truck grill 120 and the truck hood 123; and a section corresponding with the indicia simulating the truck bed 124. A score line 126 separates side 94 from the section 123 which simulates the truck hood. Another fold or score line 128 separates the rear portion of side 94 and the truck bed-simulating section 124.

Truck bed section 124 is provided with a food item-receiving opening defined by a pair of transversely spaced, longitudinally extending cuts 130 and 132; a perforated score line 134 extending between cuts 130 and 132; and a transverse cut 136 extending between cuts 130 and 132. When the planar portion defined by cuts 130, 132, and 136 is folded downwardly along perforated score line 134 in the manner illustrated in FIGS. 5 and 6, the forward wall 138 of the truck bed is formed thereby. A cut 140 is formed in portion 138 and defines a locking tab 142 which, as best seen in FIG. 5, is lockably receivable within perforation 110 formed in the bottom-defining portion of the toy vehicle.

Spaced rearwardly, or to the left of transverse cut 136 as viewed in FIG. 8, is a fold or score line 144. The portion to the left of score line 144 corresponds with the imprinted indicia simulating the tailgate 146 of the truck bed. Formed within section 146 is a perforated score 148 which defines a locking tab 150. As best seen by referring to FIG. 6, locking tab 150 is receivable in perforation or die cut 108 formed in the bottom-defined portion of the toy truck. When portion 146 is folded downwardly along score line 144 in the manner illustrated in FIG. 6, and tab 150 is inserted into perforation or die cut slot 108, the tailgate portion 144 of the toy truck is thereby formed.

A transversely extending cut 152 is formed in the grill-defining portion 120 of the side 100 and defines a locking tab 154 which is lockably received within perforation or die cut slot 108 formed in the bottom-defining portion of the toy vehicle. When portion 120 is folded downwardly along transverse fold line 156 in the manner shown in FIG. 6, locking tab 154 is receivable in slot 108 thereby forming the grill portion of the toy truck.

Figure 5:
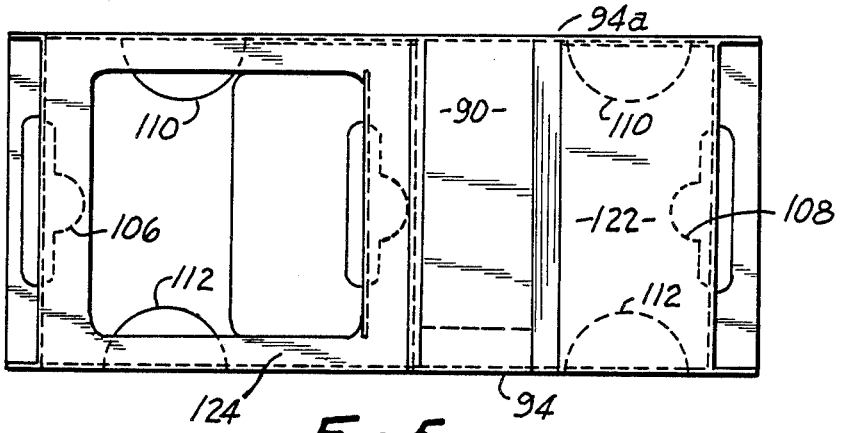
FIG. 5 is a plan view of an alternate form of advertising device of the invention.

When the planar sheet 100 is folded along the previously identified score lines so as to take on the configuration of the toy truck shown in FIGS. 5 through 7, the locking tabs 150, 154, and 142 function t lock the structure in an assembled configuration to stabilize the toy truck in its erected configuration. To add further stability to the device, tabs T and T1 are provided on portions 94 and 123 of sheet 100. These tabs are preferably coated with a suitable adhesive material so that upon folding the structure along the score lines provided on sheet 100, tabs T and T1 can be adhesively interconnected with portions 90 and **94*a***, respectively, of the toy vehicle.

When desired, portion 138 of the truck bed section of the toy vehicle can be imprinted with appropriate indicia thereby making this portion a redeemable coupon, redeemable for free or discount food at the fast food take out establishment.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An advertising device for use by fast food take-out restaurants and the like as a foldable food tray, the tray, when fully folded, taking the shape and design of a toy vehicle having a top, a bottom, and spaced apart sides, and comprising a single generally planar sheet of relatively stiff foldable material having first and second sides, said first side having indicia printed thereon simulating a windshield and wheels, said sheet including:

(a) an elongated central portion simulating the top of the toy vehicle, said central portion having:
  (i) at least two longitudinally spaced, tranversely extending fold lines;
  (ii) at least two transversely spaced, longitudinally extending cuts extending between said fold lines; and
  (iii) a transverse cut disposed intermediate said transverse fold lines and extending between said transversely spaced, longitudinally extending cuts;

(b) first and second side portions disposed adjacent said central portion, said first and second side portions being divided respectively from said central portion by first and second longitudinally extending fold lines, each said first and second side portions having a longitudinally extending bottom edge-defining fold line disposed intermediate one of said first and second longitudinally extending fold lines and a longitudinally extending free edge, portions of said first and second side portions intermediate said longitudinally extending edges and said bottom edge-defining fold lines simulating the bottom of the toy automobile, and said portions intermediate said bottom edge-defining fold lines and said first and second longitudinally extending fold lines simulating the sides of the toy automobile;

(c) means for securing said central portion to said bottom forming portions to hold the device in an erected shape.

2. An advertising device as defined in claim 1 in which said central portion of said generally planar sheet of material includes a downwardly foldable forward portion having indicia printed on said first side thereof simulating an automobile hood, grill and front bumper.

3. An advertising device for use by fast food takeout restaurants and the like as a foldable children's food tray, the tray, when fully folded, taking the shape and design of a toy automobile having a top, a bottom, and spaced apart sides, and comprising a single generally planar sheet of relatively stiff foldable material having first and second sides, said first side having indicia printed thereon simulating a windshield and wheels, said sheet including:

(a) an elongated central portion simulating the top of the toy automobile, said central portion having:
  (i) a first transverse fold line disposed proximate one end thereof;
  (ii) a first perforation provided proximate said first fold line for forming a first locking tab;
  (iii) a second transverse fold line disposed proximate the other end thereof;
  (iv) a second perforation provided proximate said second fold line for forming a second locking tab;
  (v) third and fourth longitudinally spaced, transversely extending fold lines disposed intermediate said first and second fold lines;
  (vi) a pair of transversely spaced, longitudinally extending cuts extending between said third and fourth fold lines; and
  (vii) a transverse cut disposed intermediate said third and fourth transverse fold lines and extending between said pair of transversely spaced, longitudinally extending cuts, the portion of planar material disposed between said transverse cut and said third transverse fold line corresponding with the indicia simulating the toy automobile windshield;

(b) first and second side portions disposed adjacent said central portion, said first and second side portions being divided respectively from said central portion by first and second longitudinally extending fold lines, each said first and second side portions having:
  (i) a curved edge portion;
  (ii) a longitudinally extending bottom edge defining fold line disposed intermediate one of said first and second longitudinally extending fold lines and a longitudinally extending free edge, portions of said first and second side portions intermediate said longitudinally extending edges and said bottom edge-defining fold lines simulating the bottom of the toy automobile, and said portions intermediate said bottom edge-defining fold lines and said first and second longitudinally extending fold lines simulating the sides of the toy automobile;
  (iii) a pair of longitudinally spaced, arcuate cuts disposed proximate said bottom-defining fold lines corresponding with the indicia simulating the lower half of the toy automobile wheels; and
  (iv) first and second longitudinally spaced cutouts for receiving said first and second locking tabs respectively.

4. An advertising device as defined in claim 3 in which said central portion of said generally planar sheet of material includes a downwardly foldable forward portion having indicia printed on said first side thereof simulating an automobile hood, grill and front bumper.

5. An advertising device as defined in claim 4 in which said central portion of said generally planar sheet of material includes a downwardly foldable rearward portion provided with an arcuate cut, said rearward portion having indicia printed on said first side thereof simulating a spare tire and rear bumper of an automobile.

* * * * *